United States Patent [19]

Aslund et al.

[11] Patent Number: 4,565,668

[45] Date of Patent: Jan. 21, 1986

[54] METHOD OF MAKING POWDER-METALLURGICAL ARTICLES

[76] Inventors: Christer Aslund, Bruksgränd 14; Claes Tornberg, Staltappargatan 27, both of S-64400 Torshälla, Sweden

[21] Appl. No.: 668,296

[22] Filed: Nov. 5, 1984

[30] Foreign Application Priority Data

Oct. 21, 1983 [DE] Fed. Rep. of Germany ..... 3338369

[51] Int. Cl.[4] ..... B22F 1/00

[52] U.S. Cl. ..... 419/68; 419/42; 29/DIG. 31; 75/228; 264/313; 428/35; 428/398

[58] Field of Search ..... 419/42, 66, 68; 29/DIG. 31; 75/228; 264/313; 428/35, 398

[56] References Cited

U.S. PATENT DOCUMENTS 1,081,618 12/1913 Madden ..... 419/68
3,780,418 12/1973 Hurst ..... 419/68 X
3,862,286 1/1975 Couchman ..... 419/68
3,892,030 7/1975 DePierre et al. ..... 419/66
4,000,235 12/1976 Leemput ..... 419/42 X

*Primary Examiner*—Stephen J. Lechert, Jr.
*Attorney, Agent, or Firm*—Andrus, Sceales, Starke & Sawall

[57] ABSTRACT

A method of making powder-metallurgical articles, in which powder of metal and/or metal alloys is filled into a thin-walled casing, whereupon the casing is closed and subjected to cold-isostatic pressure. Thereby the powder within the casing is compacted to form a strong or, respectively, dimensionally stable article. When the casing wall includes a joining weld seam, said casing wall is provided with an elastically expandable layer in the close vicinity of the weld seam in order to prevent formation of a fold, preferably in such a way that an approximately uniform prestress is applied to the wall surface.

8 Claims, 4 Drawing Figures

METHOD OF MAKING POWDER-METALLURGICAL ARTICLES

Figure 1:
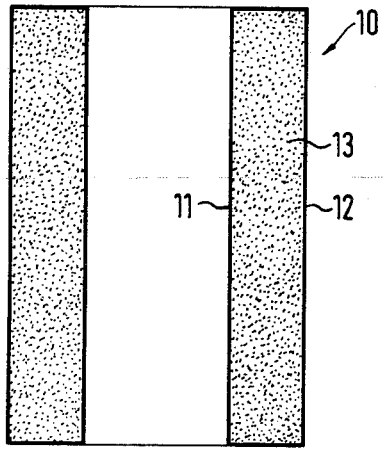

The invention is directed to a method of making powder-metallurgical articles in accordance with the preamble of patent claim 1, and to the use of the method for making elongated articles, especially pipes.

It has been generally known for the making of powder-metallurgical articles to fill the metal powder into thin-walled casings whose shape conforms to that of the articles to be made. Subsequently, the casings which are filled with metal powder are closed and subjected to a cold-isostatic pressure whereby the powder is compacted such that solid or, respectively, dimensionally stable articles are obtained. With articles of larger dimensions, at least the external casing wall is provided with an approximately straight joining weld seam preferably extending approximately longitudinally of the casing. This weld seam constitutes an extremely critical region. Experiments have shown that a longitudinal fold extending into the casing interior is formed along the weld seam in the direct vicinity of the same when the cold-isostatic pressure is applied, i.e., during cold-isostatic compacting. In such a case the compact has to be rejected; the resulting losses as to machine time and material will be obvious.

The instant invention is therefore based on the object of preventing the above-mentioned formation of a fold during isostatic compacting in the region of the weld seam.

This object is solved in a surprisingly simple way by the characterizing features of patent claim 1.

Preferred embodiments of the invention are described in the subclaims. The method according to the invention has proven especially advantageous for the making of elongated articles, especially pipes, whose outer wall is provided with one or several weld seams extending in longitudinal direction of the pipe.

Due to the measure according to the invention to provide the wall surface including the weld seam with an elastically expandable layer of hard rubber or like material such that an approximately uniform prestress is applied to said surface, it is possible to achieve an approximately uniform pressure distribution throughout the entire circumference of the casing wall. Surprisingly, it is possible in this way to reliably prevent the formation of a fold along the weld seam upon application of cold-isostatic pressure. Of course, it is an essential prerequisite for the function of the elastically expandable layer that the same should be in tight engagement with the outer surface of the casing wall and preferably exerts an approximately uniform surface pressure.

The elastic layer may either be bonded to the outer surface of the casing wall or may merely be pulled or reverse-drawn over the outer surface of the casing wall. Fixing of the elastically expandable layer is effected by means of hose clips or adhesive tapes in the region of the casing ends.

With the casing wall being cylindrical, it is a particularly simple solution to use a sleeve of elastically expandable material having approximately the same length as the casing wall and having an inner diameter which is slightly smaller than the outer diameter of the casing wall. This sleeve is pulled over the outer casing wall prior to the application of the cold-isostatic pressure. Due to the above-mentioned ratio of diameters, tight engagement of the sleeve after fitting thereof onto the casing wall is ensured. Furthermore the correspondingly configured elastic layer will reliably exert an approximately uniform surface pressure onto the wall surface.

Preferably, the ends of the elastically expandable and pressure-distributing layer are somewhat thicker so that in this way the additional application of pressure to the ends of the casing is compensated.

Figure 2:
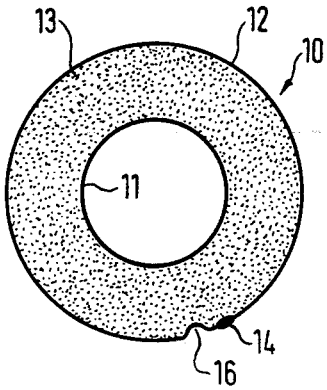
Figure 3:
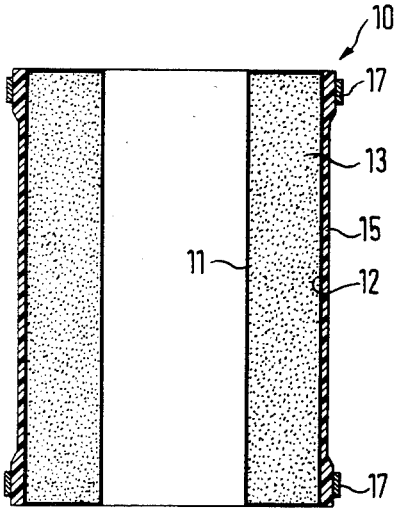
Figure 4:
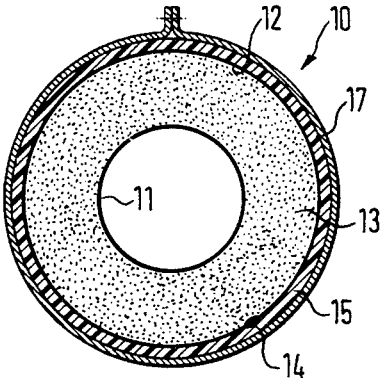

The method according to the invention will be explained again below with reference to an embodiment schematically illustrated in the accompanying drawing, in which FIG. 1 is a longitudinal sectional view of a tubular casing filled with metal powder and compacted in accordance with the conventional method, FIG. 2 is a cross-sectional view of the casing shown in FIG. 1, FIG. 3 is a longitudinal sectional view of a casing compacted in accordance with the method of the instant invention, and FIG. 4 is a cross-sectional view of the casing shown in FIG. 3.

The tubular casing 10 shown in FIGS. 1 and 2 is filled with preferably spherical powder 13 of metal and/or metal alloys and is closed on all sides. The inner casing wall 11 is integrally formed, whereas the outer casing wall 12 is formed of a thin-walled sheet-metal blank bent to form a cylindrical sleeve and having its abutting longitudinal edges joined to each other by means of an approximately straight weld seam 14 extending in longitudinal direction of the casing. When cold-isostatic pressure is applied for compacting the metal powder within the casing 10 to thereby obtain an article (pipe length) that is solid or, respectively, dimensionally stable throughout, there is the risk of a longitudinal fold being formed in the vicinity of the joining weld seam 14, said fold extending into the casing interior and being, of course, undesirable. In such a case the compact has to be rejected. The longitudinal fold evidently is formed due to a kind of notch effect of the weld seam 14.

It has now been found surprisingly that the tendency of a fold being formed near the weld seam 14 may be safely eliminated by covering the outer surface including the weld seam (external pipe wall 12) with an elastically expandable layer 15, e.g. in the form of a sleeve of elastically expandable material such as hard rubber, caoutchouc or the like (FIGS. 3 and 4). In the embodiment illustrated in FIGS. 3 and 4, the sleeve 15 of elastically expandable material, which is fitted onto the external wall 12, is of greater thickness in the region of the ends of the casing 10 than intermediate said ends, whereby compensation for the pressure applied to the ends of the casing 10 is achieved. The inner diameter of the elastically expandable sleeve 15 is somewhat smaller than the outer diameter of the casing 10 or the external casing wall 12, respectively, so that the sleeve 15 reliably and closely engages the outer wall 12 of the casing 10 and applies an approximately uniform prestress thereto. The sleeve 15 of elastically expandable material causes an approximately uniform pressure distribution upon application of a cold-isostatic pressure, whereby the above-mentioned fold formation in the region of the longitudinal weld seam 14 is avoided. Said fold is indicated at 16 in FIG. 2.

In the embodiment shown in FIGS. 3 and 4, the sleeve 15 of elastically expandable material is secured adjacent the ends of the casing 10 by means of conventional hose clips 17.

The elastically expandable layer is also relatively thin-walled. The wall thickness corresponds approximately to that of the casing skin. Preferably, the wall thickness of the elastically expandable layer 15 is about twice the wall thickness of the casing skin 11 or 12, respectively.

All of the features disclosed in the application papers are claimed as being essential to the invention insofar as they are novel over the prior art either singly or in combination.

We claim:

1. A method of making powder-metallurgical articles, in which powder of metal and/or metal alloys fills a thin-walled closed casing and cold-isostatic pressure is applied to the casing whereby the powder within the casing is compacted so as to form a solid or dimensionally stable article said casing having an outer wall surface with an approximately straight joining weld seam, comprising applying to the outside of said wall surface including said weld seam prior to the application of the cold-isostatic pressure a closely fitting and elastically expandable layer of an elastically expandable material preferably in such a way that an approximately uniform prestress is applied to the wall surface.

2. The method of claim 1 wherein the wall surface including the weld seam is surrounded by an elastically expandable band defining said layer.

3. The method of claim 1 wherein said layer is a sleeve of elastically expandable material drawn over the wall surface including the weld seam.

4. The method of claim 1 wherein said layer is formed by coating the wall surface including the weld seam with an elastically expandable and shrinkable material which shrinks onto the wall surface and establishes an approximately uniform prestress.

5. The method of claim 1 wherein said casing is a cylindrical casing and the wall surface including the weld seam is provided with said elastically expandable layer, and said layer has a thickness greater in the region of the casing ends than intermediate said ends.

6. The method of claim 1 wherein said casing is a tubular casing and the wall surface including the weld seam is provided with said elastically expandable layer having a thickness greater in the region of the casing ends than intermediate said ends.

7. The method of claim 1 including encircling fastening means securing said layer to the wall surface of the casing.

8. An elongated article, comprising an outer casing, a pipe member within said outer casing, the outer surface of said casing being provided with at least one approximately straight weld seam extending in the longitudinal direction of the pipe, and an elastically expandable and close fitting layer secured about the casing for thereafter applying a cold-isostatic pressure to the covered casing.

* * * * *